United States Patent [19]

Heinz et al.

[11] 4,351,623

[45] Sep. 28, 1982

[54] UNDERWATER STORAGE OF OIL

[75] Inventors: Edward J. Heinz, Spring; H. Thomas Collins, Houston, both of Tex.

[73] Assignee: Raymond International Builders, Inc., Houston, Tex.

[21] Appl. No.: 158,071

[22] Filed: Jun. 10, 1980

[51] Int. Cl.[3] ..... E02B 17/00

[52] U.S. Cl. ..... 405/210; 114/256; 405/59; 210/522

[58] Field of Search ..... 405/195, 201-210, 405/59, 60; 114/256, 257

[56] References Cited

U.S. PATENT DOCUMENTS

| | | | |
|---|---|---|---|
| 2,383,840 | 8/1945 | Benckert . | |
| 2,631,558 | 3/1953 | Harris | 114/256 |
| 3,145,539 | 8/1964 | Estes et al. | 405/210 |
| 3,146,458 | 8/1964 | Estes et al. | 114/257 X |
| 3,322,087 | 5/1967 | Tucker . | |
| 3,408,971 | 11/1968 | Mott . | |
| 3,545,215 | 12/1970 | Burrus . | |
| 3,630,161 | 12/1971 | Georgii . | |
| 3,686,886 | 8/1972 | Georgii . | |
| 3,695,047 | 10/1972 | Pogonowski et al. . | |
| 3,703,467 | 11/1972 | Lummus et al. | 210/522 |
| 3,752,318 | 8/1973 | DeRoven et al. | 210/522 X |
| 3,753,494 | 8/1973 | Hirata | 114/257 X |
| 3,762,548 | 10/1973 | McCabe | 405/60 X |
| 3,893,918 | 7/1975 | Favret . | |
| 3,943,724 | 3/1976 | Banroli et al. . | |

FOREIGN PATENT DOCUMENTS

| | | | |
|---|---|---|---|
| 1544710 | 4/1979 | United Kingdom | 405/60 |

OTHER PUBLICATIONS

Offshore-Jul. 1977, pp. 154-155, 13, 126-136.
Ocean Industry, Aug. 1977, pp. 52-54.

*Primary Examiner*—Dennis L. Taylor
*Attorney, Agent, or Firm*—Fitzpatrick, Cella, Harper & Scinto

[57] ABSTRACT

An offshore oil storage facility on a sea bed which can withstand the effects of waves, tides and oil transfer even though it is of lightweight steel construction. The oil in the tank floats on a layer of water and standpipes extend up from the water layer to a location under the sea surface. Oil containment casings in the form of tubular shells surround the upper ends of the standpipes and extend above the sea surface. Differential pressure sensors arranged to sense differential pressure across the tank walls are used to control the pumping of fluids into and out from the tank to minimize such pressure differentials.

19 Claims, 6 Drawing Figures

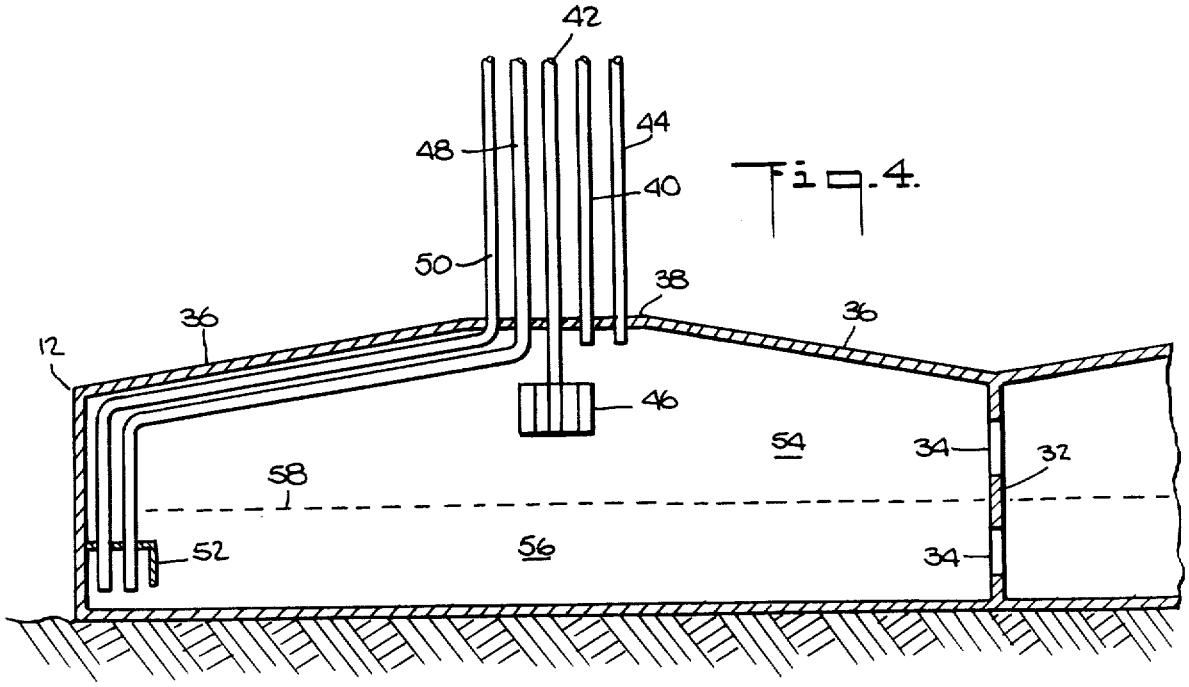
Fig. 4.
Fig. 3.
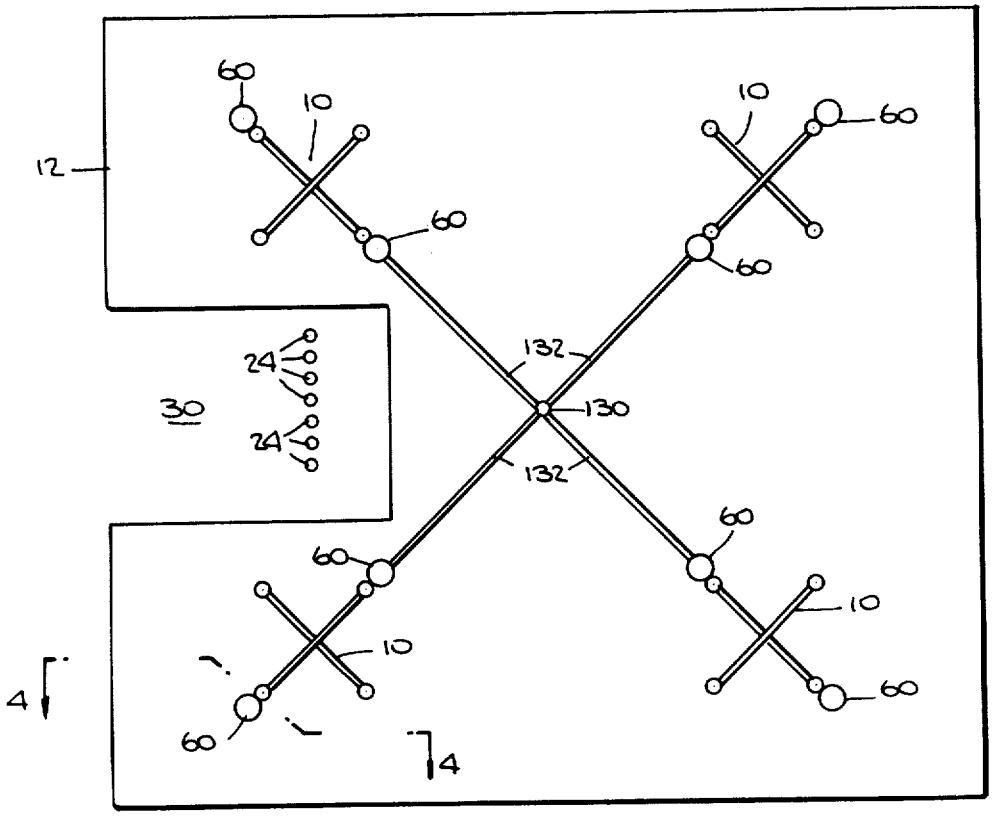

UNDERWATER STORAGE OF OIL

BACKGROUND OF THE INVENTION

1. Field of the Invention

This invention relates to underwater offshore storage of liquids such as oil and, in particular, it concerns novel undersea oil storage arrangements characterized by economical, lightweight construction and nonpolluting operation.

2. Description of the Prior Art

Underwater offshore oil storage facilities have previously been proposed for various applications. Examples of such proposals are given in U.S. Pat. Nos. 3,322,087; 3,408,971; 3,695,047 and 3,943,724. It has been found that when such storage facilities are to be provided at large water depths and are to have large storage capacities, very substantial forces are produced on their wall surface by the action of waves and tides and by the pressure differentials which occur as oil is transferred into and out from their interior. In some instances, for example, as shown in U.S. Pat. Nos. 3,322,087 and 3,408,971, the oil contained within the device floats on a layer of water which is in open communication with the sea. While this serves to help minimize pressure differentials across the walls of the structure, it raises a danger of pollution because oil mixes with the layer of water on which it floats and may thus easily escape to the sea. U.S. Pat. No. 3,943,724 proposes to provide a flexible membrane between the oil and the water in an undersea storage tank but such membranes are expensive, unreliable and not suited to very large installations. As a result it has been necessary in the past to build large undersea oil storage facilities of very heavy reinforced concrete to ensure that the oil containing compartments were isolated from the sea and at the same time to withstand the large forces produced by the sea on the walls of the oil compartments. These concrete structures were expensive to manufacture; and, because of their great weight, their installation was also very difficult and expensive.

U.S. Pat. No. 3,893,918 proposes a separator conduit or "skim pile" for containing oil and separating it from water at an offshore location; but it provides no indication as to how the oil storage problem described above can be solved.

SUMMARY OF THE INVENTION

The present invention overcomes the above described difficulties of the prior art and permits undersea storage of oil in an economical and nonpolluting manner without danger of fracture and spillage due to pressure differentials caused by tides, waves or movements of oil into and out from the storage facility. With the present invention thick walled concrete structures are not needed to contain the oil but instead steel plate construction may be used.

In one aspect the present invention comprises an enclosed tank or mat supported on a sea bottom and containing a layer of oil floating on a layer of water. A structure, for example an offshore tower supporting an oil drilling and production platform, extends up from the tank to a location above the sea surface. An oil line is supported by the structure and extends therealong from a location communicating with the layer of oil to a location above the sea surface. A water standpipe is also supported by the structure and extends therealong from a location communicating with the layer of water to a submerged location above the tank. A tubular oil containment casing surrounds the upper end of the water conduit means and extends from a location below said upper end to a location above the sea surface. The oil containment casing is open to the sea below the upper end of the water conduit means.

The pressure of the water external to the tank is communicated to the interior of the tank via the oil containment casing and the standpipe. In this manner the pressure differential across, and accordingly the forces on, the walls of the tank are minimized; so that an economical lightweight, e.g. steel plate, construction may be used for the tank. Although the sea level above the tank may change due to waves and tides, these changes are communicated equally to the interior and exterior of the tank and accordingly the walls of the tank are not subjected to appreciable stress. The surrounding sea is protected from oil pollution even though it is in open communication with the water layer on which the oil floats. This is due to the fact that any water which exits from the tank must pass up through the water conduit means and must exit inside the oil containment casing. Any oil in the water will rise upwardly in the oil containment casing and can be recovered there.

According to a further aspect of the invention an enclosed tank, which contains a layer of oil floating on a layer of water, is supported from a sea bottom; and a structure extends upwardly from the tank or mat above the sea surface. At least one oil line is supported by the structure and extends therealong from a location communicating with the layer of oil to a location above the sea surface where it receives oil, for loading the mat. At least one other oil line, supported by the structure, supplies oil for offloading the tank. A water line is also supported by the structure to extend from a location communicating with the layer of water in the tank to a location above the tank. Pumping means and adjustable flow control means are interposed along the water line. Differential pressure sensors are arranged just inside and outside the walls of the tank to sense the differential pressure across the walls; and the signals from these pressure sensors are processed and used in controlling the adjustable flow control means so as to maintain the net flow of liquid into and out from the tank at a proper value so as to minimize pressure differentials across and stresses on the tank walls.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification, wherein:

FIG. 3 is a plan view taken along line 3—3 of FIG. 1;

FIG. 4 is an enlarged fragmentary section view taken along line 4—4 of FIG. 3;

DETAILED DESCRIPTION OF THE PREFERRED EMBODIMENT

Figure 1:
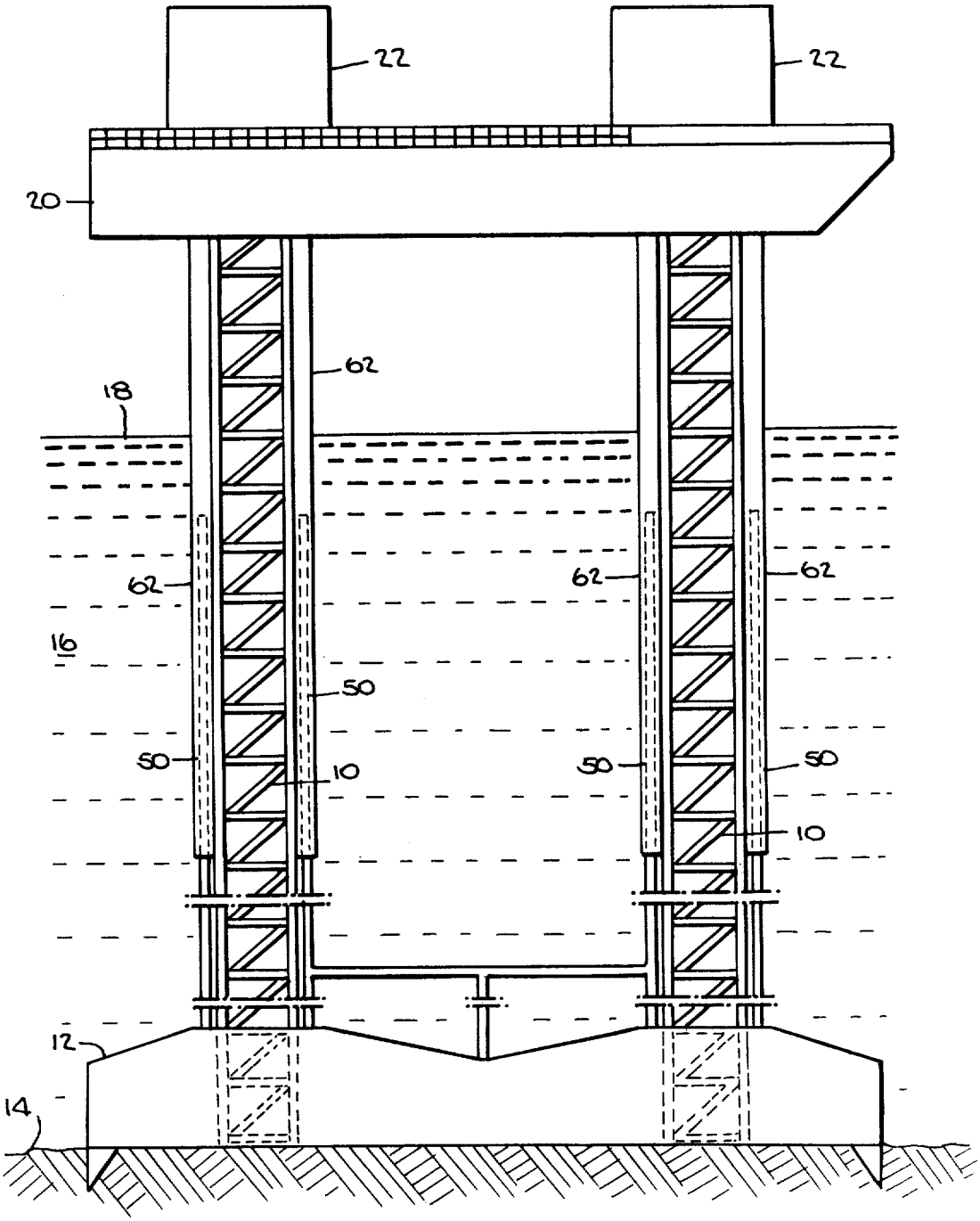
FIG. 1 is a side elevational view of an offshore oil drilling and production tower in which the present invention is embodied.
Figure 2:
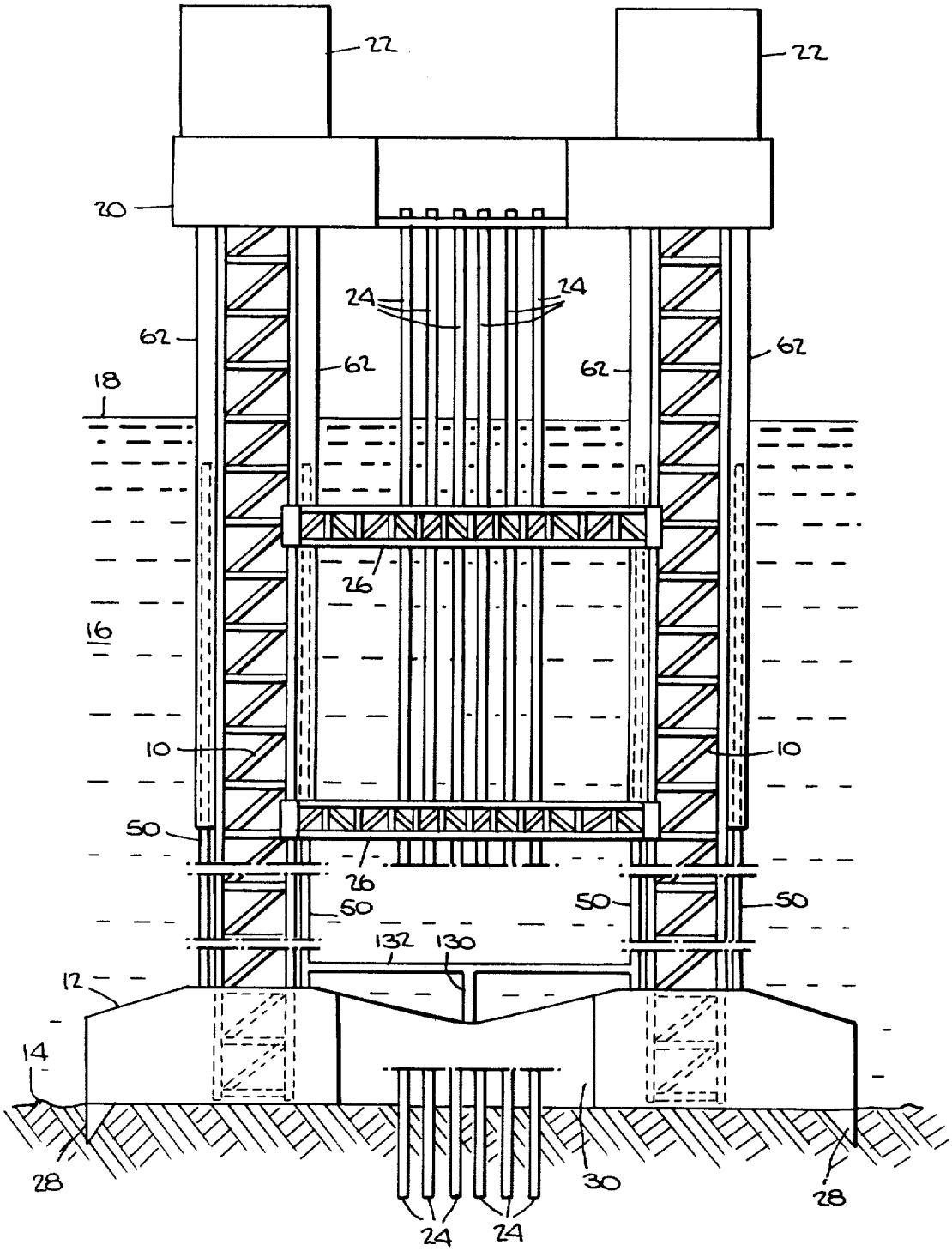
FIG. 2 is a front elevational view of the tower of FIG. 1.

The present invention is particularly suited for use in connection with offshore drilling and production towers where crude oil is taken up from beneath the sea bed and then stored prior to transfer to a tanker (not shown). As shown in FIGS. 1 and 2, such an offshore tower comprises a plurality of openwork legs 10 which extend upwardly from an oil storage mat 12 on sea bed 14, through a body of water 16 and past the sea surface 18 to a platform 20. The platform 20 is supported by the legs 10 sufficiently above the sea surface 18 to be isolated from the effects of tides and waves. The platform 20 contains the usual drilling and production equipment and crew facilities; but these are not shown herein since they are not part of the present invention. However, for purposes to be described more fully hereinafter, there are diagrammatically shown oil-water separators 22 which are known per se and which remove water from the oil prior to transfer of the oil to the mat or to a tanker. Again, the specific construction of these devices does not form part of the present invention; and since these are well know per se, they are not described herein.

As shown in FIG. 2, a plurality of conductor pipes 24 extend down from the platform 20, through the body of water 16 and into the sea bed 14. These conductor pipes 24 serve to guide and protect drill strings during drilling operations; and they later serve, during production, i.e. when oil is being withdrawn from the drilled hole in the sea bed, to protect and support the conduits which carry the oil from the sea bed to the platform. The conductor pipes 24 are supported at various depths in the body of water 16 by conductor supports 26 which extend between the legs 10.

The oil storage mat 12 is in the form of a large tank of welded steel plate construction. As can be seen in FIGS. 1 and 2 the legs 10 extend up through the mat and are supported by it at the sea bed 14. The mat 12 is provided with skirts 28 which extend down from its outer edges and into the sea bed to prevent lateral shifting. The mat 12 is also formed with a cut-out portion or notch 30 to allow the conductor pipes 24 to pass down into the sea bed 14.

The oil storage mat 12, as shown in FIG. 4, is completely enclosed. Bulkheads 32 are provided inside the mat to divide it into compartments; and ports 34 are formed in these bulkheads to permit free flow of oil and water between the compartments.

The mat 12 has sloping upper walls 36 which rise to apexes 38 at various spaced apart locations; and oil, water and gas vent lines enter the mat at these apexes. As can be seen in FIG. 4 there is provided a gas vent line 40 which opens inside the mat 12 at the highest location of the apex 38 to withdraw gases which collect in this region of the mat. There are also provided crude oil inlet and crude oil outlet lines 42 and 44 which extend into the upper region of the mat 12 somewhat below the gas vent line 40. An oil inlet sparger 46 is provided at the end of the crude oil inlet line 42 to diffuse the force of incoming oil and thereby minimize turbulence and oil and water mixing inside the mat. A seawater ballast outlet line 48 and a water standpipe 50 are also provided and these enter the top of the mat 12 and extend down to its lower region where they open under a baffle wall 52.

As shown in FIG. 4, the mat 12 contains a layer of oil 54 which floats on top of a layer of water 56, the interface between the oil and the water being represented by a dashed line 58. As more oil is added to the mat it displaces the water and the interface line 58 lowers. As oil is withdrawn from the mat, water enters to replace the depleted oil and the interface line 58 rises.

Figure 5:
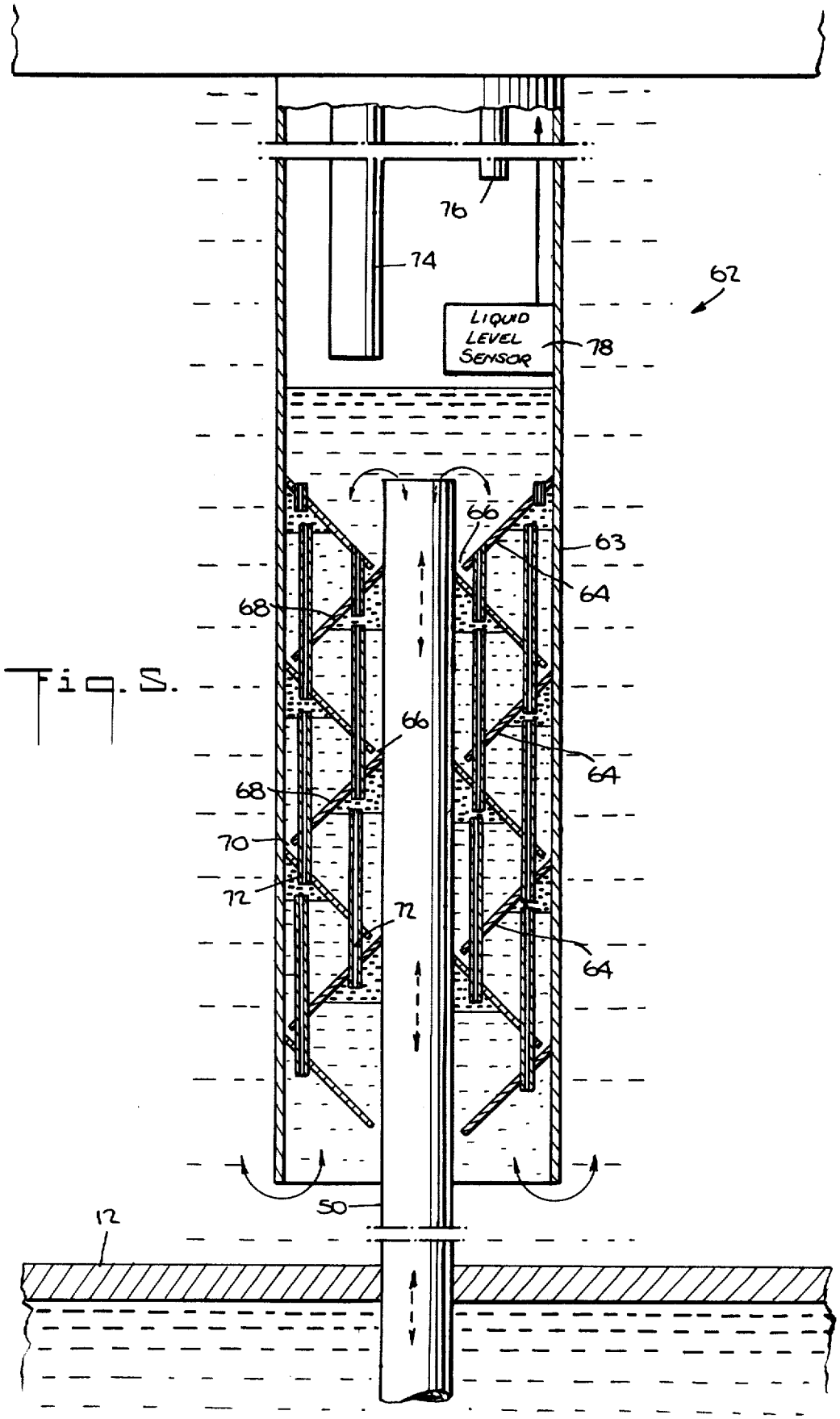
FIG. 5 is an enlarged fragmentary view, partially in section, showing an oil containment casing used in the embodiment of FIG. 1.

Each group of lines including the gas vent line 40, the oil lines 42 and 44, the seawater outlet ballast line 48 and the water standpipe 50 is represented diagrammatically in FIG. 3 by a single circle 60. As can be seen therein, each group of these lines is positioned adjacent one of the legs 10 to extend upwardly therealong from the mat 12 toward the platform 20. All of the lines, except the water standpipe 50 extend fully up to the platform 20. The water standpipe 50 terminates and opens beneath the sea surface 18. As can be seen in FIG. 5, the upper end of the water inlet line 50 opens inside an oil containment casing 62. The oil containment casing 62 extends from a location below the upper end of the water standpipe 50, where it opens into the body of water 16, to a location above the sea surface 18. As can be seen in FIGS. 1 and 2 the oil containment casing 62 are also supported by the legs 10 and they extend to the platform 20.

As shown in FIG. 5 the oil containment casings 62 each comprise a tubular shell 63 into which the upper end of the water inlet line 50 extends. A plurality of conical disk shaped oil separation baffles are mounted to the inner surface of the shell 63 at spaced apart locations along its length. These baffles extend from against the casing wall and slope downwardly to locations displaced a short distance from the water standpipe 50 to leave passageways 66 therebetween. There are also provided a plurality of conical hat shaped oil separation baffles 68 mounted on the outer surface of the water standpipe 50 at spaced apart locations therealong alternately interspersed among the baffles 64. The baffles 68 extend from against the water standpipe 50 and slope downwardly to locations displaced a short distance from the casing shell 63 to leave passageways 70 therebetween. Oil riser pipes 72 extend upwardly from the uppermost region just under each of the oil separator baffles 64 and 68 and through these baffles to transfer oil collected thereat up to the upper region of the casing shell 63.

It will be seen that seawater from the body of water 16 can pass in through the bottom of the casing shell 63 and past the passageways 66 and 70 to the open upper end of the water standpipe 50. If, however, any water should be forced out of the water standpipe from the mat 12, the oil entrained in this water will float toward the top of the casing shell 63. To the extent that water may continue to be forced out from the water standpipe 50 it will pass downwardly in the casing shell 63, but the continuous tendency of the oil contained in this water to float will result in the oil being collected in the uppermost regions just under the oil separator baffles 64 and 68. This separated oil is then directed by the riser pipes 72 to upper region of the casing 63. The progress of the water in the oil containment casing 62 is represented in FIG. 5 by double ended solid arrows and the progress of the oil is represented by single ended dashed arrows.

A liquid removal line 74 extends downwardly into the upper end of the casing 62 from the platform 20 to withdraw oil which accumulates therein. In addition a vent line 76 also extends down into the casing 62 above the line 74 to withdraw gases which collect therein. There is also provided a standpipe liquid level sensor 78 inside the casing 62 to sense the rising of accumulated oil in the casing beyond a predetermined level. This sensor produces a signal which is used to start a skim pile pump 80 (FIG. 6) to pump oil out of the skim pile through the liquid removal line 74 and into the oil water separator 22.

Figure 6:
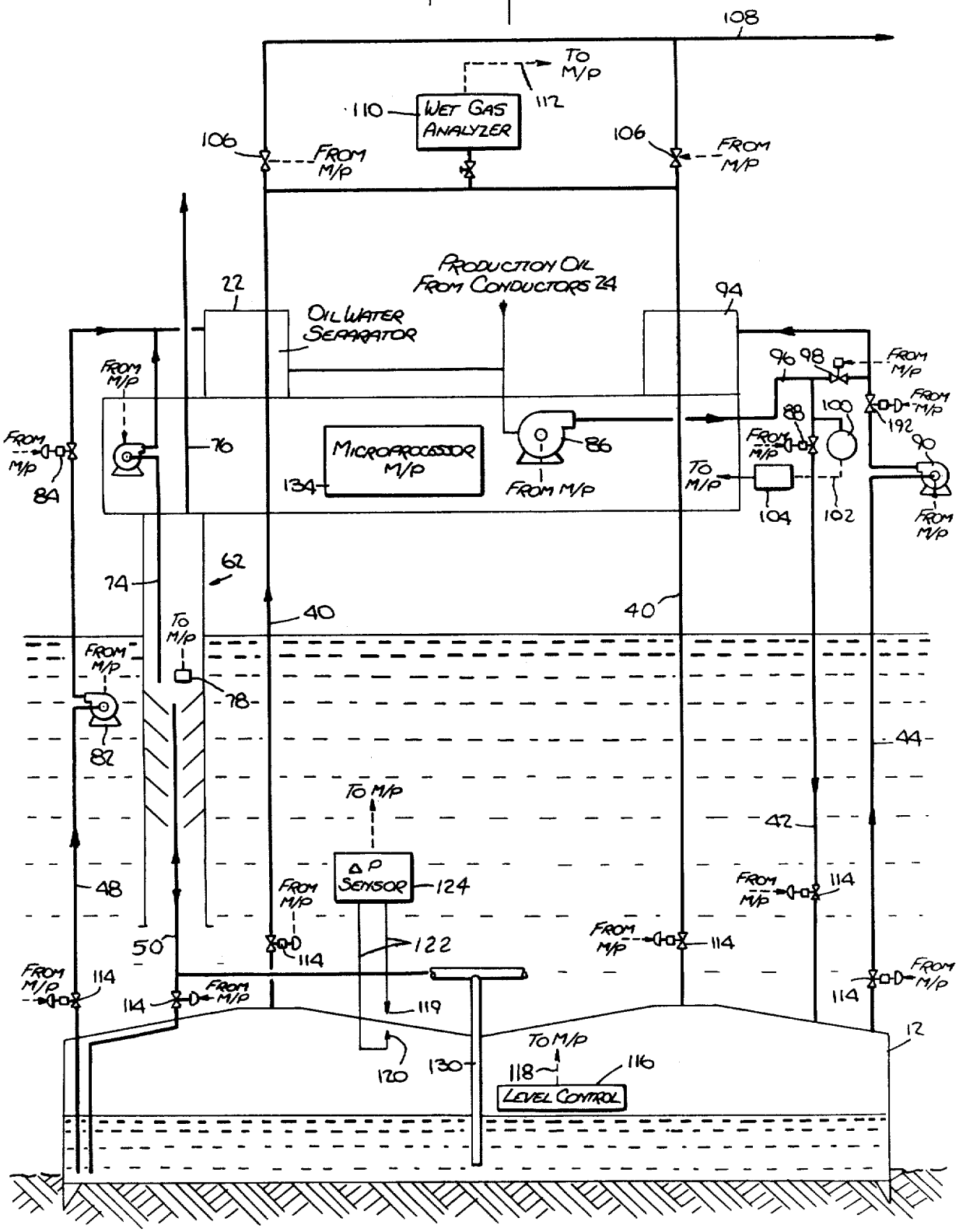
FIG. 6 is a schematic showing fluid flow control arrangements incorporated in the embodiment of FIG. 1.

FIG. 6 shows diagrammatically the overall flow control arrangements employed in the above-described drilling and production tower to permit loading of crude into the mat 12, to permit off loading of oil from the mat and to maintain a minimum pressure differential across the mat walls during loading, offloading and variable sea conditions. For purposes of clarity, only the gas vent lines 40 are shown entering the mat compartments at their apicies. The crude oil inlet and outlet lines 42 and 44 are shown entering one compartment and the seawater ballast outlet line 48 and the standpipe 50 are shown entering another compartment. With one exception, described hereinafter, it is not inportant where the oil and water lines 42, 44, 48 and 50 enter the mat, so long as the mat compartments are interconnected to permit ready flow to these lines from all locations within the mat. As will be explained more fully hereinbelow the location of the standpipes 50 is specially chosen to minimize the effects of different pressures at different locations on the mat caused by a wave passing over it.

As shown in FIG. 6 a seawater ballast pump 82 is interposed along the seawater ballast line 48. Actually this pump may comprise several pumps connected in parallel to accommodate different required flows. The outlet of the pump 82 is connected through a seawater ballast outlet control valve 84 to the oil-water separator 22.

The oil-water separator 22 comprises devices well known in the art for removal of water from oil. The separated water is then returned to the sea via appropriate means (not shown). The oil water separator 22 also includes means for separating water from the production oil withdrawn from the undersea well being tapped.

The separated oil from the oil water separator 22 is pumped by a transfer pump 86 to the oil inlet line 42. Again the transfer pump 86 may comprise a plurality of pumps connected in parallel so as to accommodate different flow requirements. An oil inlet control valve 88 is interposed along the oil line 42.

An oil booster pump 90 is interposed along the oil outlet line 44. This pump, which may be of the submersible variety, may also comprise a plurality of pumps connected in parallel to accommodate different flow requirements. The output of the oil booster pump 90 is connected through an oil outlet control valve 92 to a crude oil loading tank 94 on the platform 20. The loading tank 94 is constructed and adapted to transfer oil to a tanker moored to the offshore tower. A transfer line 96 containing a transfer valve 98 is interposed between the oil inlet and outlet lines 42 and 44 above the inlet and outlet control valves 88 and 92. An inlet line pressure sensor 100 is interposed in the oil inlet line 42 above the oil inlet control valve 88. The pressure sensor 100 produces an electrical output which is connected, via a transfer pump control line 102, to control the transfer pump 86, so as to stop the pump when the pressure in the line 42 above the control valve 88 exceeds a predetermined amount. A bypass switch 104 is interposed in the control line 102 to override operation of the pressure sensor 100 during certain stages of operation.

As indicated schematically in FIG. 6, production crude oil from the conductors 24 (FIG. 2) is also delivered, for example by the transfer pump 86, to the oil inlet line 42.

In the diagram of FIG. 6 two gas vent lines 40 are shown and these are each provided with a solenoid valve 106 at their upper ends. The gas vent lines 40 are connected above the valves 101 to a common vent line 108 which leads to a flare stack (not shown) where the gases are burned. The gas vent lines 40 are connected below the valves 106 to a wet gas analyzer 110. This analyzer senses the composition of the gases in the lines 40 and transmits signals via a solenoid valve control line 112 which are used to control the valves 106 to regulate the flow of gases to the flare.

Near the lower end of each group of gas vent line 40, oil lines 42 and 44, seawater ballast outlet line 48 and standpipe 50, there are provided isolation valves 114 which can be quickly closed to prevent flow into or out from the mat 12. There is also provided a level control sensor 116 inside the mat 12 to sense when the oil-water interface 58 (FIG. 4) drops below a predetermined level corresponding to the maximum oil containing capacity of the mat. Signals from the sensor 116 are transmitted via a liquid level signal line 118 to control operation of the isolation valves 114 in the gas vent lines 40.

Pressure sensors 119 and 120 are provided just under and above the upper wall 36 of the mat 12. The outputs of the pressure sensors are transmitted via differential pressure lines 122 to a differential pressure sensor 124 which transmits electrical signals corresponding to the pressure differential above and below the wall 36. These outputs are used to control the seawater ballast outlet and the oil inlet control valves 84 and 88 to adjust the opening of these valves whenever the differential pressure across the upper wall 36 of the mat exceeds a predetermined amount. The valves 84 and 88 as thus controlled maintain the set flow of liquid into and out from the mat at a proper value to minimize pressure differentials across and stresses on the mat walls.

The underwater oil storage facility described above has the following modes of operation:

a. Initial Start Up;
b. Loading Crude Oil into the Mat;
c. Loading Crude Oil into the Mat while Simultaneously Offloading Oil from the Mat to a Tanker Moored nearby;
d. Offloading Oil from the Mat with No Oil Being Loaded into the Mat;
e. Normal Shutdown and Dormant Status; and
f. Emergency Shutdown and Dormant Status.

Each of the foregoing modes of operation will now be described.

a. Initial Start Up

When the mat 12 is first installed, it is initially flooded with seawater and the control valves 88 and 92 are closed as is the transfer valve 98. The differential pressure inside and outside of the mat is maintained at zero by virtue of the standpipe 50 which communicates between the interior of the mat and the sea outside. As the sea level rises due to increasing tide or to a wave passing over, the resulting increased head of water imposed on the top of the upper wall 36 of the mat 12, is also communicated via the standpipe 50 to the interior of the mat so that the differential pressure across the wall 36remains at zero. Thus the mat is capable of encountering substantial changes in water pressure without undergoing corresponding changes in differential pressure across its walls. For this reason the mat 12 does not have to be of heavy concrete construction as was the case in the prior art.

As had been pointed out in connection with FIG. 3 there are provided groups of gas, oil and water lines, including standpipes 50 and associated oil containment casings 62, alongside each of the tower legs 10. The spacing and arrangement of the standpipes 50 is chosen to accommodate the varying pressures across the width or length of the mat 12 due to a wave which progresses across the surface of the water. By way of example a wave may have a total height, from trough to crest of eighty-eight feet (26.8 meters) which corresponds to a maximum pressure variation of thirty-six pounds per square inch (3 $Kg/cm^2$). By providing enough standpipes 50 very close to each other, the different pressures at the different lateral locations could theoretically be communicated directly to the corresponding lateral locations of the mat and no pressure differential at all would be encountered anywhere across the mat wall 36. It has been found, however, that it is not necessary to provide such an elaborate and expensive arrangement. Instead, by placing the standpipes 50 at selected spaced apart locations, as shown in FIG. 3, it is possible to accommodate the variation in pressure head as a wave passes over the mat. As shown by the circles 60 in FIG. 3 (which represent the gas, oil and water lines, including the standpipes 50) the standpipes are located along the diagonal inside and outside corners of each of the tower legs 10.

Referring now to FIGS. 1, 3 and 6, it will be seen that there is also provided a centrally located standpipe 130 extending up from the center of the mat 12 and connected, just above the mat, to horizontal crossover pipes 132 which communicate with the standpipes alongside the inner corners of each of the tower legs 10. The centrally located standpipe 130 communicates to the central region of the mat 12 the average pressure in the four standpipes 50 to which it is connected; and this provides, in effect, a central unsupported standpipe in the center of the mat. This arrangement provides a standpipe relatively close to every location within the mat so that irrespective of the direction in which a wave passes over the mat, the pressure variation is the direction of the wave will be accommodated by the strategically positioned standpipes. Thus, as viewed in FIG. 3 the maximum distance between standpipes in the X or Y direction or in a quartering (i.e. diagonal) direction for a mat whose width and length are 345 feet (105 meters) and 385 feet (117 meters) respective, is about one hundred fifty feet (45.7 meters). This is one eighth of the above-mentioned total wave length or one fourth of the distance from the wave trough to the wave crest. This corresponds to a maximum pressure variation of nine pounds per square inch (0.633 $Kg/cm^2$) due to wave height differential between standpipes. However, since each standpipe maintains a zero pressure differential at its particular location the maximum pressure variation occurs half way between standpipes and is therefore only four and one half pounds per square inch (0.316 $Kg/cm^2$). This is well within the load bearing capacity of steel construction.

b. Loading Crude Oil Into the Mat

This procedure is initiated by opening the bypass switch 104, starting the transfer pump 86 and opening the oil inlet control valve 88. Oil from the production well begins to flow down through the crude oil inlet line 42 into the mat 12. At this time the bypass switch 104 is closed so that the transfer pump 86 will be stopped should the pressure in the inlet line 42 exceed a predetermined value.

When oil begins to flow into the mat 12, the seawater balast pump 82 is started and the seawater ballast outlet control valve 84 is opened. Seawater now flows out of the mat 12 and up through the seawater ballast outlet line 48 to the oil-water separators 22. The inlet and outlet control valves are regulated so that the amount of water flowing out of the mat corresponds to the amount of oil flowing into the mat. To the extent that the inlet and outlet flows may be unequal, an automatic compensation is achieved by the standpipes 50 which allow seawater to flow into or out of the mat so that the pressure differential across the upper wall 36 of the mat is maintained at essentially zero.

While in theory all of the seawater displaced by the incoming oil could flow out of the mat via the standpipes 50, it is preferred that the major portion of the displaced seawater be directed up to the oil-water separators 22 on the platform 20 where maximum separation of large volumes can be assured. In this manner the flows in the standpipes 50 are minimized and the oil containment casings 62 can accommodate such flows to maintain automatic pressure control with minimum danger of oil leakage into the sea.

c. Loading Crude Oil Into the Mat While Simultaneously Offloading Oil From the Mat to a Tanker Moored Nearby This procedure is carried out as in the case of loading oil into the mat except that in this case the oil booster pump 90 is started and the oil outlet control valve 92 is opened. Oil now flows into the mat via the oil inlet line 42 and at the same time oil flows out from the mat up through the oil outlet line 44 to the crude oil loading tank 94. In this case the seawater ballast outlet control valve is partially closed so that only so much seawater is allowed to flow out from the mat as is necessary to accommodate the difference between the oil flowing into the mat via the oil inlet line 42 and the oil flowing out of the mat via the oil outlet line 44. During this operation also, any net differential between the amount of liquid flowing into the mat and the amount of liquid flowing out of the mat is accommodated by the standpipes 50 so that the pressure differential across the mat walls remains at or close to zero.

If desired, the transfer valve 98 may be opened at this time so that some or all of the production oil may bypass the mat and flow directly into the crude oil loading tank 94.

d. Offloading Oil From the Mat with No Oil Being Loaded Into the Mat

In this case the transfer pump 86 is not operated and the oil inlet control valve 88 is closed. Also, the seawater ballast pump 82 is not operated and the seawater ballast outlet control valve 84 is closed. However, the oil booster pump 90 is operated and the oil outlet control valve 92 is opened. As oil flows out from the mat through the oil outlet line 44 and through the oil booster pump 90, seawater enters into the mat from inside the oil containment casings 62 and the standpipes 50 to accommodate the oil outflow. This seawater inflow is automatically controlled to maintain a zero pressure differential across the mat walls. Moreover since during this mode of operation there is no outflow of seawater no separate seawater flow lines have to be provided to avoid pollution.

e. Normal Shutdown and Dormant Status

When oil is being loaded into the mat, as above described the transfer pump 86 and the seawater ballast pump 82 are operating and the oil inlet control valve 88 and the seawater ballast outlet control valve 84 are both open. To start the shutdown sequence the seawater ballast outlet control valve 84 is closed and the seawater ballast pump 82 is stopped to stop seawater from flowing out through the seawater ballast outlet line 48. The oil outlet control valve 88 is closed to stop oil flowing into the mat. When the valve 88 closes, the pressure in the line 42 above the valve 88 will increase. This pressure increase is sensed by the inlet line pressure sensor 100 which transmits a signal via the transfer pump control line 102 to stop operation of the transfer pump 86. During this entire sequence, and after, the pressure inside the mat is automatically maintained by the standpipes 50 to correspond to the pressure outside the mat to minimize stresses on the mat wall.

If, at the time shutdown is to take place, oil is being loaded into the mat while oil is simultaneously being offloaded to a tanker, the transfer pump 86 and the oil booster pump 90 are both operating and the oil inlet control valve 88 and the oil outlet control valve 92 are both open. Also if the net inflow of oil via the oil inlet line 42 is to exceed the net outflow of oil via the oil outlet line 44, the seawater ballast pump 42 will be in operation and the seawater ballast outlet control valve will be partially open. To effect shutdown under these conditions the seawater ballast control valve 84, if open, is closed and the seawater ballast pump 82 is stopped. The oil inlet and outlet control valves 88 and 90 are closed and the pressure sensor 100 causes the transfer pump 86 to stop as above described. The oil booster pump 90 is then stopped. Again, both during and after shutdown, the standpipes 50 maintain the pressure inside the mat at or nearly at that of the surrounding sea so that stresses on the mat walls are minimized.

f. Emergency Shutdown and Dormant Status

At any time flows into and out from the mat can be stopped by triggering any or all of the isolation valves 114.

During each of the different modes of operation described above the pressure sensors 119 and 120 sense the actual pressure differential across the walls 30 of the mat 12. Should this pressure differential exceed a predetermined limit, as when flows in the standpipes 50 are interrupted or are insufficient to accommodate the net flow differential into or out from the mat, the sensed pressure differential signals are applied to the oil inlet control valve 88 and the seawater ballast outlet control valve 84 to adjust them so as to minimize the net flow differential.

The various pumps and valves employed in the mat control system described herein are, in theory, controllable manually according to the sequences described above for each of the modes of operation. However, it is preferred to provide a mechanical program to turn pumps on and off and to open and close the various valves in the predetermined sequence for each mode of operation. One such type of program arrangement may employ a microprocessor. This is indicated symbolically in FIG. 6 by a box 134. All of the valves and pumps are controlled by signals supplied from the microprocessor 134; and, as indicated by the dashed arrows "to M/P", signals from the level control sensors 78 and 116, and from the pressure sensors 100 and 124 and from the wet gas analyzer 110 are all applied to the microprocessor 134. The microprocessor, in turn, produces valve and pump control signals, as indicated by dashed arrows "from M/P", which are used to control the pumps 80, 82, 86 and 90 and the valves 84, 88, 92, 98, 100, 106 and 114. The microprocessor is also arranged to receive manual inputs to set the system to any desired mode of operation or to override any operation being carried out.

The specific manner in which the signals from the various sensors are processed in the microprocessor and are supplied from the microprocessor to the various pumps and valves is not part of the present invention; and any of several well known arrangements can be organized for achieving each sequence of pump and valve control based on manual inputs, preprogrammed timing or pressure signals as described above in connection with the various modes of operation.

Accordingly in the interest of clarity the specific details of the electrical circuits and microprocessor arrangements are not described herein.

It will be appreciated from the foregoing that the present invention makes possible lightweight and inexpensive steel construction for the mat 12 by providing means to maintain minimum pressure differential across the mat walls. The particular arrangements of the standpipes 50 and the valve control based on the pressure sensors 119 and 120 both serve to accomplish this. It is to be understood that these two aspects of the invention may be used in conjunction with each other as described herein, or they may be used independently.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. An offshore oil storage facility comprising an enclosed tank supported from a sea bottom, said tank containing a layer of oil floating on a layer of water, a structure extending upwardly from said tank to a location above the sea surface, an oil line supported by said structure and extending therealong from a location communicating with said layer of oil in said tank to a location above the sea surface, a water standpipe supported by said structure and extending therealong from a location communicating with said layer of water to a submerged location above said tank and an oil containment casing comprising a tubular shell surrounding the upper end of said water conduit means and extending from a location below said upper end to a location above the sea surface, said tubular shell being open to the sea below the upper end of said water standpipe.

2. An offshore oil storage facility according to claim 1 wherein said structure extending upwardly from said tank includes a plurality of spaced apart legs and wherein separate standpipes and associated oil containment casings extend from different locations on said tank and are supported by different ones of said legs.

3. An offshore oil storage facility according to claim 1 wherein at least one central standpipe extends out of said tank at a location intermediate other standpipes, said central standpipe being connected to each of said other standpipes near said tank whereby the pressure communicated to said control standpipe is the average of the pressures in said other standpipes.

4. An offshore oil storage facility according to claim 1 wherein said oil containment casing is also supported on said upwardly extending structure.

5. An offshore oil storage facility according to claim 1 wherein said upwardly extending structure comprises a plurality of spaced apart legs which support an oil production platform above the surface of the sea.

6. An offshore oil storage facility according to claim 5 wherein there are provided a plurality of said standpipes and associated oil containment casing supported by said spaced apart legs to extend up from different locations along said tank.

7. An offshore oil storage facility according to claim 1 wherein an output pump is provided along said oil line to transfer oil out from said tank.

8. An offshore oil storage facility according to claim 1 wherein an inlet pump is provided along said oil line to transfer oil into said tank.

9. An offshore oil storage facility according to claim 8 wherein a seawater ballast line extends from the layer of water within said tank to a location above the sea surface and a seawater ballast pump is interposed along said seawater ballast line to remove water from said tank as oil is pumped into said tank.

10. An offshore oil storage facility according to claim 9 wherein pressure sensors are provided just inside and outside said tank to monitor the pressure differential across the tank walls and flow control means are provided to reduce the net flow into and out from said tank via said oil line and said seawater ballast line in response to predetermined pressure differentials sensed by said pressure sensors.

11. An offshore oil storage facility according to claim 1 or 9 wherein there are provided separate oil inlet and oil outlet lines extending along said supporting structure from the oil layer within said tank to inlet and outlet locations above the surface of the sea and pumps interposed along each of said lines.

12. An offshore oil storage facility according to claim 1 wherein liquid level sensing means are provided inside said oil containment casing to sense the level of the oil accumulated therein and oil containment casing pump means arranged to pump oil out from said oil containment casing in response to a signal from said liquid level sensing means.

13. An offshore oil storage facility comprising an enclosed tank supported from a sea bottom, said tank containing a layer of oil floating on a layer of water, a structure extending upwardly from said tank to a location above the sea surface, an oil line supported by said structure and extending therealong from a location communicating with said layer of oil in said tank to oil conduit connector means thereabove for connecting said oil conduit means to a source or a receiver of oil, oil pumping means interposed along said oil line between said tank and said connector means, a water line supported by said structure and extending therealong from a location communicating with said layer of water and oil separation means above said tank, water pumping means interposed along said water line between said tank and said water and oil separation means, pressure differential sensing means arranged to sense pressure differential above and below the upper surface of said tank and control means responsive to a predetermined pressure differential sensed by said sensing means to control the relative operation of said oil and water pumping means so as to reduce said pressure differential.

14. An offshore oil storage facility according to claim 13 wherein said control means comprise an adjustable valve located at the output of at least one of said pumping means.

15. An offshore oil storage facility according to claim 13 wherein said water pumping means is arranged to pump water out of said tank and said oil pumping means is arranged to pump oil into said tank.

16. An offshore oil storage facility according to claim 13 wherein said facility further includes a second oil line extending from the oil layer in said tank to a location above the sea surface and oil pumping means along said second oil line arranged to pump oil out from said tank.

17. An offshore oil storage facility according to claim 13 wherein said structure extending upwardly from said tank comprises a plurality of legs supporting an oil production platform above the level of the sea and wherein said oil and water lines are supported by said legs.

18. An offshore oil storage facility according to claim 13 wherein said facility further includes at least one water standpipe extending upwardly from the water layer inside said tank to a location in the sea below the surface thereof and wherein an oil containment casing in the form of a tubular shell surrounds the upper end of said standpipe and extends up to the surface of the sea.

19. An offshore oil storage facility according to claim 1 or 13 wherein said tank is of steel construction.

* * * * *